US005817164A

United States Patent [19]

Dorofeev et al.

[11] Patent Number: 5,817,164

[45] Date of Patent: Oct. 6, 1998

[54] METHOD AND APPARATUS FOR MAKING FEEDSTOCK FOR STEEL MAKING

[75] Inventors: Genrikh Alexeevich Dorofeev, Tula; Serafim Zakharovich Afonin, Moscow; Alexei Grigorievich Zubarev, Tula; Evgeniy Nektarievich Ivashina, Tula; Alexandr Vladimirovich Makurov, Tula; Alexandr Nikolaevich Panfilov, Tula; Vyacheslav Vasilievich Ryabov, Lipetsk; Anatoly Georgievich Sitnov, Tula; Jury Viktorovich Utkin; Evgeniy Khristoforovich Shakhpazov, both of Moscow; Mark Aronovich Tseitlin, Tula, all of Russian Federation

[73] Assignee: Aktsionernoe Obschestvo Zakrytogo TIPA "Intermet-Service & Co.", Russian Federation

[21] Appl. No.: 615,206

[22] PCT Filed: Feb. 23, 1995

[86] PCT No.: PCT/RU95/00031

§ 371 Date: Mar. 12, 1996

§ 102(e) Date: Mar. 12, 1996

[87] PCT Pub. No.: WO95/23660

PCT Pub. Date: Sep. 8, 1995

[30] Foreign Application Priority Data

| | | | |
|---|---|---|---|
| Mar. 4, 1994 | [RU] | Russian Federation | 94007130 |
| Aug. 23, 1994 | [RU] | Russian Federation | 94030509 |

[51] Int. Cl.[6] ..... C21C 5/28; B22D 3/00; C22B 1/00

[52] U.S. Cl. ..... 75/548; 75/10.61; 75/316; 75/751; 164/97; 164/129; 164/323; 164/412

[58] Field of Search ..... 164/97, 129, 323, 164/412; 75/316, 751, 10.61, 548

[56] References Cited

U.S. PATENT DOCUMENTS

| | | | |
|---|---|---|---|
| 2,710,796 | 6/1955 | Pinkerton | 75/961 |
| 3,807,986 | 4/1974 | Funk et al. | 75/11 |
| 4,287,936 | 9/1981 | Ljublinsky et al. | 164/329 |
| 4,436,551 | 3/1984 | Mori | 75/12 |
| 4,564,388 | 1/1986 | Vallomy | 75/10.42 |
| 4,957,546 | 9/1990 | Lazcano-Navarro | 75/532 |
| 5,425,797 | 6/1995 | Dorofeev et al. | 75/318 |

FOREIGN PATENT DOCUMENTS

| | | |
|---|---|---|
| 6941008 | 8/1970 | France . |
| 706184 | 12/1979 | U.S.S.R. . |
| 985063 | 12/1982 | U.S.S.R. . |
| 805634 | 5/1983 | U.S.S.R. . |
| 1105273 | 7/1984 | U.S.S.R. . |
| 1148696 | 4/1985 | U.S.S.R. . |

(List continued on next page.)

*Primary Examiner*—Melvyn Andrews
*Attorney, Agent, or Firm*—David L. Garrison; Matthew J. Marquardt

[57] ABSTRACT

Improvements in metallurgical conversion in accordance with the present invention consist in the preparation of a semifinished item (a charge stock) in the form of a pig by forming thereof in a molding box of a casting machine from a solid filler, for the most part an oxidizing agent, and a liquid pig iron followed by cooling, provided said solid filler and said liquid pig iron undergo, in the process of forming, an action which prevents the floating up of the solid filler in the liquid pig iron. Such an action is effected both by applying a mechanical force, in particular by providing a casting machine with a cantilever (8) having a hollow roller (9) which rests on a molding box (2) and a weighting material (10), and by choosing relative dimensions of the solid filler pieces and selecting a rate of pig casting. Optimal conditions for using such semifinished item for metallurgical conversion which in accordance with the present invention is carried out in oxygen converters and arc furnaces are described.

15 Claims, 1 Drawing Sheet

FOREIGN PATENT DOCUMENTS

| | | |
|---|---|---|
| 1250582 | 8/1986 | U.S.S.R. . |
| 1547940 | 3/1990 | U.S.S.R. . |
| 1788029 | 1/1991 | U.S.S.R. . |
| 1787659 | 1/1993 | U.S.S.R. . |
| 437807 | 7/1994 | U.S.S.R. . |
| 1275570 | 5/1972 | United Kingdom . |
| 1458228 | 12/1976 | United Kingdom . |
| 1503497 | 3/1978 | United Kingdom . |
| 2078785 | 1/1982 | United Kingdom . |

METHOD AND APPARATUS FOR MAKING FEEDSTOCK FOR STEEL MAKING

FIELD OF THE INVENTION

The present invention relates to the field of ferrous metallurgy, more particularly to metal casting, namely to the casting of foundry pigs (that is to say metal casts intended for subsequent remelting), specifically to the manufacture of prepared blend materials for the steel-smelting production and also to machines for the casting of pigs primarily from pig iron with fillers.

The present invention relates also to processing of metal (melt) in a liquid or viscous state in casting molds and namely in molding boxes of casting machines using the pressure, specifically using mechanical devices.

More particularly, the present invention relates to processing of pig iron for the production of iron and steel effected both in converters and in electric furnaces, for example arc furnaces.

BACKGROUND OF THE INVENTION

When performing metallurgical conversion, that is to say while converting pig iron into steel, including the addition of a scrap metal, by various known processes such as the open-hearth, the converter, the electro-smelting processes, a blend, that is to say, a mixture of materials necessary to provide a predetermined chemical composition of metal and slag obtained, is also charged into a corresponding melting furnace apart from pig iron and a scrap metal. As a rule, the blend includes primarily oxidizing agents needed for a chemical coupling and for removing from a bath the carbon and other unwanted ingredients of the melt, such as sulfur, phosphorus, manganese and the like.

An important stage in the preparation of the blend resides in forming thereof, that is to say imparting a shape convenient both for transporting and storing and for charging into a corresponding melting furnace. Thus, granulation, agglomeration and briquetting of dispersed ingredients with the addition of binders have been widely used heretofore (M. A. Nechiporenko, "Pelletizing Fine Concentrates", Leningrad, 1958; L. A. Lurie, "Briquetting in Metallurgy", Moscow, The State Scientific and Technical Institute for Ferrous and Non-Ferrous Metallurgy, 1968; B. M. Ravig, "Briquetting Ores and Ore-Fuel Blends", Moscow, Nedra, 1968).

In a number of cases, it is convenient to form the blend (the charge stock) in the form of pigs from iron-carbon alloys, as a rule from pig iron with the addition thereto of fillers of a required composition, in particular of iron-ore pellets (USSR Inventors' Certificate No. 985063) or ore-carbon pellets (USSR Inventors' Certificate No. 1250582 of Aug. 15, 1986; Bulletin of Inventions Nov. 30, 1986) which in fact represent a semifinished item for metallurgical conversion. Such pigs are prepared in molding boxes of a casting machine filled with pellets from corresponding feeders and cast with pig iron. Here, cooling of a liquid pig iron is carried out at the expense of heating pellets, reducing oxides and heating a mould working surface being exposed to a pig (USSR Inventors' Certificate No. 1105273, which seems to be the closest prior art).

Charging of various melting furnaces with such a stock, i.e. with pigs, appears to be extremely convenient and technologically effective. At the same time, there is a problem of achieving stability of a composition of a given semifinisehd item for metallurgical conversion, which is especially actual for low-volume smeltings, as well as for the preparation of section steels, in particular in oxygen converters and arc furnaces, since the use of half-finished articles with unstable composition and thermal properties does not favour stability of steel-smelting procedures and techniques.

SUMMARY OF THE PRESENT INVENTION

It is, therefore, the principle object of the present invention to create a process for the preparation of a semifinished item for metallurgical conversion in the form of pigs formed in a molding box of a casting machine from a solid filler and a liquid iron-carbon alloy followed by cooling, which provides for stability of a composition of ingredients.

It is another object of the present invention to create a casting machine for the preparation of a semifinished item for metallurgical conversion of a relatively stable composition.

It is further object of the present invention to create a semifinished item for metallurgical conversion in the form of a pig from an iron-carbon alloy with a solid filler characterized by a homogeneous and stable composition and suitable for easy and effective use in the processes of metallurgical conversion, in particular for a small-volume smelting as well as for a fine steel smelting.

It is yet another object of the present invention to use a semifinished item for metallurgical conversion in steel smelting, particularly in oxygen converters as well as in arc furnaces.

The above and other objects are accomplished according to the present invention in the preparation of a semifinished item for metallurgical conversion by forming thereof in a molding box of a casting machine from a solid filler and a liquid iron-carbon alloy followed by cooling in the form of a pig, provided the solid filler and a liquid iron-carbon alloy undergo, in the process of forming, an action which prevents the floating up of the solid filler in a liquid iron-carbon alloy.

Such an action is required to achieve the aim of the present invention, since it has been discovered that heterogeneity of a composition of pigs obtained was associated with the fact that due to a difference in densities of the solid filler and the liquid iron-carbon alloy, the floating of the filler and its removal from a molding box occured in the process of pouring the filler with the alloy, wherein a low viscosity of said alloy in a hot state was insufficient to prevent this fact. In the case of pouring the filler with a solidifying alloy (according to an increased viscosity), the alloy was not able to fill in all the gaps between the filler pieces and, accordingly, it failed to bind the filler which led to the falling down of a part of the filler when discharging the pig from the molding box. In both cases, this resulted in an uncontrolled change of a composition of a semifinished item for metallurgical conversion.

In the preparation of a semifinished item without the aforementioned action, the solid filler in the bulk of a molding box (a pig) is not uniformly distributed due to a difference between the apparent densities of iron-carbon alloy (for example, pig iron density if 7 g/cub. cm) and a filler (for example, a density is 3.7 g/cub. cm as to pellets). An upper part of the pig contains a very low proportion of iron-carbon alloy and a great deal of the filler; on the other hand, a lower part of the pig is almost wholly composed of iron-carbon alloy and contains little or no filler. In the upper part of the pig, particles of the filler are very weakly bonded by iron-carbon alloy and, when the pig falls down from the casting machine onto a flat-car, particles of the filler separate out from the pig thereby forming a mound which is non-magnetic and not subjected to loading along with the pigs, when shipping to a consumer. As a result, the pigs contain an insufficient amount of the solid filler in comparison with an estimated one. This results, for example in that during a subsequent conversion, for example in an arc furnace, an oxidizing period of steel smelting increases by 10–15 percent for the lack of oxygen introduced by pellets to oxidize pig iron admixtures.

In practice, pig iron is used in most cases, however this fact should not be considered as a restriction of common conditions of the present invention.

Within the scope of this text, the term "a solid filler" denotes any filler required to provide a predetermined chemical composition of metal obtained; among them and first of all, these may be solid oxidizing agents being a source of oxygen for a chemical bonding and removing carbon and other unwanted ingredients of the melt. In a preferred embodiment of the present invention, it is advisable that solid oxidizing agents be taken with a total amount of oxygen needed for the oxidation of 5 to 95 percent carbon and a total estimated oxidation of the remaining ingredients of iron-carbon alloy which possess an affinity to oxygen to a greater extent than carbon does.

With the aforementioned total amount of oxygen when carrying out a subsequent conversion, one may simultaneously obtain a required degree of oxygen removal, an increased rate of metal dephosphorization and a sufficient slag frothing at the exspense of carbon oxide bubbles released by the reaction of carbon oxidation, which affords a slag protective effect, in particular in electric furnaces, that is to say arc screening by the slag. If a total oxygen content is less than the amount needed for the oxidation of 5 percent carbon and for a total oxidation of other metal admixtures, then the reactions of carbon and phosphorus oxidation proceed with difficulty. In this case, metal has an elevated phosphorus and carbon content. If a total oxygen content is in excess of the amount needed for the oxidation of 95 percent carbon and for a total oxidation of other elements, then the carbon content in a bath is unduly low and, on the contrary, the oxygen content is high, which is undesirable both for the reasons of conditions of a furnace output, a flow rate of deoxidizers, metal quality and for the reasons of a range of steel grades produced.

In accordance with another preferred feature of the invention, a solid filler and iron-carbon alloy are subjected, in the process of forming, to the action of force preventing the floating up of said solid filler in a liquid iron-carbon alloy, which action is effected mechanically, that is to say by distributing a force the magnitude of which in the direction perpendicular to the surface exceeds a maximum buoyant force acting upon said solid filler in said liquid iron-carbon alloy. Here, it is possible to form a semifinished item by casting a molding box with a liquid iron-carbon alloy, charging its surface with a solid filler and immersing said solid filler into a liquid phase under the action of a force the magnitude of which exceeds, in the optimal variant, by not less than 5 percent a maximum buoyant force acting upon said solid filler in iron-carbon alloy.

According to Archimedes law, anybody completely or partially submerged in a fluid (gas or liquid) at rest is acted upon by an upward, or buoyant, force the magnitude of which is equal to the weight of the fluid displaced by the body, which force is applied in the centre of gravity of the bulk of a body's submerged part. Accordingly, in order to immerse pellets and uniformly distribute thereof in the bulk of iron-carbon alloy (pig iron) prepoured into the molding box, it is necessary that the solid filler (pellets) be subjected to the action of a force exceeding the buoyant force. An excess rating (5 percent and more) has been determined experimentally. As a conveyer with molding boxes moves to a discharging end of the machine, a hard scum of pig iron becoming quickly solidified by all the mass of a semifinished item firmly keeps pellets in the bulk of pig iron. When approaching the discharging end, a mass of the semifinished item constitutes a strong unit composed of pellets firmly set by an already solidified pig iron. When a piece of such semifinished item comes against a flat-car bottom with a blow, the pellets do not run out therefrom but firmly hold out in a mass of the piece by means of a solid pig iron, since still at the stage of solidification the pellets were completely submerged in a mass of pig iron which at one stroke became solidified on a cold pellet surface, Solidification of pig iron in the semifinished item is accelerated by supplying water at an immersion device and also at a cooling zone directly toward a foundry pig present in the molding box.

In this way, it is possible to form the semifinished item by charging a molding box with the solid filler, casting thereof with a liquid iron-carbon alloy and applying to a floating up filler a force the magnitude of which, in an optimal variant, is equal to 100–10,000 N/sq. m. In the latter case, depending on temperature and, hence, viscosity of iron-carbon alloy, it is advisable to apply said force in 1–60 seconds after the solid filler has been cast with a liquid iron-carbon alloy.

An additional force exerted on the material in a molding box is necessary to immerse (drown) a floating up (because of a difference in densities of the filler and pig iron) material to a bottom part of the molding box, which provides a uniform distribution of the filler in the bulk of the foundry pig. The value of that force is determined by a depth of a material submerence in the molding box and by a weight of pig iron "squeezed-out" as a result of this, wherein said weight is referred to the surface of applying a force. For example, a material (pellets) is required to be submerged for a depth of 3 cm of the molding box. The area of applying a force, that is to say a lateral face of a roller cylindrical surface coming into contact with a heterogeneous system (pellets, pig iron) of the foundry pig, will be equal to 10×50=500 sq. m, where 10 cm—the length of the roller are coming into contact with a material in the molding box; 50 cm—the roller length. Pig iron density is 7 g/cub. cm. Pig iron volume squeezed-out by a force will be equal to 500×3=1500 cub. cm=10.5 Kg=105N. Specific pressure will be equal to 105:500=0.20 N/sq. cm, or 2000 N/sq. m. The actual pressure must be over by a force directed to deform a metal scum formed.

In cases where pig iron with an increased viscosity (pig iron having a temperature close to solidification) is used, it will take much more force to drown (immerse) the material in the molding box than it is required according to estimated values—up to 10,000 N/sq. m.

If the value of a force acting on a material in the molding box is less than 100 N/sq. m. the effect of submergence of a solid oxidizing agent, that is to say pellets, will be negligible and the pellets will not be distributed uniformly in the pig bulk (pellets will be practically absent in the bottom part of the molding box). With the value of a force over 10,000 N/sq. m the mechanism of pellet submergence is complicated, overall dimensions of its units are enlarged, unfavourable conditions effect the machine on the whole, which complicates operation thereof.

A time period from the moment of casting pig iron and the onset of applying a force for submersion (drowning) of a material in the molding box basically depends on the temperature of pig iron cast in the molding boxes. If the temperature of pig iron varies over the ranges close to solidification (1,200°–1,260° C.) then, in order to drown a material in the molding box, one should apply a force practically immediately on termination of the casting process, i.e. in one second. After pig iron has become solidified in the molding box it is practically impossible to load a material thereto.

If pig iron is cast being physically hot, a time period for applying a force to drown (immerse) the material deep in the molding box may be equal to one minute following termination of the pig casting. To change a time of applying a force in an effort to immerse (drown) it in the molding box, a pressing device (a roller with a cantilever and a weight) may be displaced, as the need arises, approaching or moving away from the place of casting pig iron in the molding boxes. To apply a force to the surface of a material in the molding box after expiration of one minute from the moment of termination of the molding box casting is not to the purpose, since this results in solidification of pig iron in the upper part of the foundry pig.

In accordance with another embodiment of the present invention, an action, in the process of forming, on the solid filler and a liquid iron-carbon alloy which prevents the floating up of said solid filler in said liquid iron-carbon alloy, may be provided by using pieces having the size of 0.025 to 0.300 of the molding box height, and casting thereof with iron-carbon alloy in the ratio of its average linear velocity to the linear velocity of the molding box movement equal to from 3:10 to 6:10.

It seems that the last-mentioned parameter needs to be explained in more detail. It should be understood that "an average linear velocity" of iron-carbon alloy means a volume content of a liquid iron-carbon alloy entered into the molding box per unit of time (in a user-oriented literature, this value is called as a (volume) flow rate) reffered to a cross-section of the molding box. This ratio (cub. m/s:sq. m=m/s) having the dimension of velocity characterizes an average linear velocity of iron-carbon alloy movement along a cross-section of the molding box, since a cross-section of an iron-carbon flow itself is unknown and is difficult to be determined. This value is not a real speed of iron-carbon flow but represents a nominal velocity averaged by along a cross-section of the molding box while retaining a physical meaning of exactly a linear velocity of iron-carbon alloy movement.

Casting of a liquid iron-carbon alloy into the molding boxes with the aforementioned ratio of liner velocities of iron-carbon alloy supply and molding box movement equal to from 3:10 to 6:10 provides for a uniform filtration of iron-carbon alloy in the bulk of the molding box filled with particles of a solid filler. At the same time, one may rule out a phenomenon of pouring-over of iron-carbon alloy into neighboring molding boxes which is caused by excess of the alloy casting speed over the speed of molding box movement, that is to say filling of spaces between particles of the solid filler. One may also rule out a local, nonuniform and incomplete filling of the molding boxes with iron-carbon alloy as well as solidification of iron-carbon alloy batches in the spaces between particles of the solid filler originating as a result of an insufficient feed rate of iron-carbon alloy into molding boxes, its fast cooling and solidification. The ratio of linear velocities of movement (casting) or iron-carbon alloy and molding boxes equal to from 3:10 to 6:10 is in compliance with the conditions for the preparation of moldings of blend materials with a stable ratio of iron-carbon alloy and a solid filler.

It has been discovered that if this ratio exceeds 6:10, then iron-carbon alloy has not enough time to fill all spaces between particles of the solid filler of an ore material with the result that a phenomenon of misrun of a molding box with iron-carbon alloy occurs. A part of the solid filler shall not be poured with iron-carbon alloy and shall pour out of the molding box, mass relation between iron-carbon alloy and the solid filler shall be violated as in the case of violation of the conditions for constancy of the molding composition.

If the ratio of linear velocities is less than 3:10, then a blend material molding is overflowed with iron-carbon alloy, the latter pours over into neighboring molding boxes, which also results in violation of the conditions for constancy of the molding composition.

It has also been discovered that the size of particles constituting a layer of the solid filler equal to from 0.025 to 0.300 to the molding box height is an optimal one for keeping a solid filler particle layer immovable in the molding box when the latter is poured (provided the aforementioned limitations on velocity are observed).

If a particle size of iron-ore materials is less than 0.025 of the molding box height, then pouring of the molding box with pig iron is complicated, uniformity of mixing pig iron with an iron-ore material is infringed, stability of the pig iron—iron-ore material relationship is disordered, an increased dust escape of fine particles of an ironore material is observed, and foundry pigs noticeably differ by composition.

If a particle size of an iron-ore material is more than 0.30 of the molding box height, then an upper particle layer, especially one disposed at the top of the molding box, is sluiced off by pig iron. This leads to the nonuniformity of distribution of an iron-ore material in the bulk of the molding box and to the violation of homogeneity of the composition thereof.

The above and other objects are also accomplished in accordance with the present invention by providing a casting machine for the preparation of a semifinished item for metallurgical conversion comprising a frame adapted to assemble thereon units of the casting machine, a conveyer with molding boxes assembled on the frame, a pouring device to pour a liquid iron-carbon alloy into the molding boxes and a bin with a feeder to charge a solid filler into the molding boxes. This casting machine also comprises a device adapted to apply an action to said solid filler and liquid iron-carbon alloy, which action prevents the floating up of the solid filler in the liquid iron-carbon alloy.

In a preferred embodiment, it is advisable that said machine be provided with atomizers connected to a pipe-line for supplying a cooling medium, said device for applying to said solid filler and liquid iron-carbon alloy an action preventing the floating up of the solid filler in the liquid iron-carbon alloy be made in the form of a cantilever with a hollow roller and a weighting material mounted on the cantilever with the possibility to move along its longitudinal axis, wherein said cantilever with its one end is mounted in supports on the frame and with another end, by means of a pivotably installed roller, rests on a molding box, the length of said hollow roller is from 0.80 to 0.95 of a working length of the molding box, an outside diameter of said roller is from 1.1 to 1.4 of the molding box width, the atomizers are located in the vicinity of said roller and oriented to its lateral face.

The ratio of dimensions of the roller and the molding box is of a great significance to solve a problem formulated, i.e. to produce a uniform, heterogeneous system, that is to say, to uniformly distribute an oxidizing agent in the bulk of a pig iron matrix.

If the length of the roller is less than 0.80 of a working length of the molding box, then the roller will bring pressure to bear upon the molding box walls and the process for immersing a material into a liquid pig iron will not be attained.

Said ratios of an outside diameter of the roller and the molding box width have been determined experimentally when pouring metal into the molding boxes of different capacity. Moreover, if an outside diameter of the rollers is less than 1.1 of the molding box width, a blend material and pig iron may be squeezed out of the molding box. If an outside diameter of the roller is more than 1.4 of the molding box width, this results in that the roller will start pressing the molding box walls, and a uniform, heterogeneous system will be absent in a lower part of the foundry pig.

The objects of the present invention are also accomplished by providing a semifinished item for metallurgical conversion in the form of a pig from iron-carbon alloy with a solid filler prepared by forming thereof in a molding box of a casting machine from said solid filler and liquid iron-carbon alloy followed by cooling, wherein in the process of forming, said solid filler and liquid iron-carbon alloy undergo an action which prevents the floating up of the solid filler in the liquid iron-carbon alloy, as it is described above and illustrated in the following Examples.

The objects of the present invention are also accomplished when carrying out a method for the production of steel mainly in oxygen converters comprising the steps of: charging a scrap metal and a solid oxidizing agent; pouring a liquid pig iron; blowing a bath with oxygen; and entering slag-forming constituents, said semifinished item for metallurgical conversion is used as said solid oxidizing agent in the form of a foundry pig from iron-carbon alloy with a solid filler prepared by forming thereof in a molding box of a casting machine from said solid filler and liquid iron-carbon alloy followed by cooling, wherein in the process of forming, said solid filler and liquid iron-carbon alloy undergo an action which prevents the floating up of the solid filler in the liquid iron-carbon alloy. In an optimal embodiment of the invention, it is advisable that said semifinished item for metallurgical conversion and scrap metal be taken in the ratio of from 0.1:10 to 3.0:10 and said semifinished item be charged in an amount of 25–300 Kg per ton of a liquid pig iron. Besides, it is expedient to use the semifinished item for metallurgical conversion containing an oxide material poured with iron-carbon alloy in the ratio of from 1:1 to 1.0:0.9 respectively, wherein a total oxygen content in said oxide material is equal to the amount thereof needed for a total estimated oxidation of the iron-carbon alloy ingredients having an affinity to oxygen to a greater extent than carbon does. The above ratios are explained as follows.

The content of a semifinished item in the composition of a solid blend of less than 10 percent is not to the purpose, since this fact complicates the process for preparing and charging the solid blend into a converter and, moreover, there is essentially no effect of using the semifinished item. If the ratio of the semifinished item to a metal scrap is above 3:1, the effectiveness of using thereof as a cooling agent comes down, and overheating of metal occurs at the moment of finishing the process of oxygen lancing of the blend. Using the semifinished item in the range of 25–300 Kg per ton of a liquid pig iron provides for a stable smelting in the converter with the active slag of required consistency and basicity providing an elevated dephosphorization and optimal desulfurization. The above ranges have been obtained experimentally.

The ratio of an oxide material to iron-carbon alloy in said semifinished item in excess of 1:1 is undesirable, since in this case there is an elevated consumption of the oxide material which complicates the process for preparing the semifinished item and lengthens a time period for blowing a bath in the converter. In the ratio of the oxide material to iron-carbon alloy in the semifinished item of less than 1.0:9.9 an active bath boiling takes place which may result in slag ejection.

The objects of the present invention are also accomplished in carrying out a method for the production of steel mainly in arc furnaces comprising the steps of: inlayers charging a furnace with a scarp metal and a charge stock; charging flux additives; heating and melting; oxygen lancing, with the use of a semifinished item for metallurgical conversion as a solid oxidizing agent in the form of pigs of iron-carbon alloy with a solid filler prepared by forming thereof in a molding box of a casting machine from said solid filler and liquid iron-carbon alloy followed by cooling, wherein, in the process of forming, said solid filler and liquid iron-carbon alloy undergo an action which prevents the floating up of the solid filler in the liquid iron-carbon alloy. In an optimal embodiment of said method, charging of a furnace with a scrap metal and a charge stock is carried out in two batches, wherein initially the charge stock and scrap metal are charged jointly in an amount of from 2 to 32 percent by weight of a furnace blend with the arrangement of a semifinished item for metallurgical conversion between layers of a scrap metal in the ratio therebetween of from 1.0:0.1 to 1.0:20.0 respectively, followed by charging first the scrap metal and then charging the semifinished item at the top of said scrap.

Charging the metal blend in two batches makes it possible to sharply rise heating capacity per unit of a blend mass during a smelting period thus promoting its melting and lowering power consumption.

In the first batch, a combination of a scrap metal and a charge stock possessing, in comparison with said scrap, a reduced melting temperature thanks to the presence in its composition of a low-melting pig iron, promotes the formation on the furnace hearth of a liquid melt layer formed mainly from a melted charge stock. In this case a subsequent melting of the scrap pieces takes place in a liquid metal bath having an increased value of the heat transfer coefficient. Mixing of the melt with carbon oxide bubbles formed as a result of the reaction of pig iron carbon oxidation by oxygen of a solid oxidizing agent entering into the initial composition of the charge stock, promotes heat transfer from a liquid melt to the pieces of a solid non-melted blend and increases their melting rate. A fast formation of a liquid melt layer on the furnace hearth protects the hearth from electric arcs, makes it possible to bring, within 1–3 minutes, the furnace to full power, provides for the possibility of the more early oxygen supply, favours a stable arcing, rise an average intake, promotes the slag formation and preparation of a frothed slag.

Charging the remaining metal blend with the second batch onto a partially melted charge stock makes its melting easier. The presence of the charge stock above a scrap metal favours compaction of the blend layer and a stable arcing. Moreover, during the whole melting down period, there is observed a carbon oxidation of the charge stock with a solid oxidizing agent and a slag maintenance in a frothed state due to a continuous bath boiling. Thanks to this fact, a factor of utilizing arc power is increased sharply promoting a blend melting and a bath heating.

Thus, charging a metal blend in two batches allows for reduction of a melting down period and a overall time of smelting as well as for decrease of a specific energy consumption.

A further increase of a number of batches of the charging blend is not to the purpose, since this is accompanied by time and thermal losses caused by pauses in the furnace operation which are no more made up by those advantages created by increasing a number of batches.

With the charge stock content in the first batch of less than 3 percent on the weight of a furnace burden, a liquid metal volume formed therefrom is insufficient to form on a furnace hearth a liquid metal layer, to immerse thereto pieces of a solid blend and to protect the furnace hearth from the burn-through by powerful arcs.

This fact brings down a power input and oxygen flow rate and also technical and economic performances of smelting as a whole, prevents from using fully the advantages of the present method.

With the charge stock content in the first batch of more than 32 percent on the weight of a furnace burden, a time period for smelting an initial charge and a power consumption starts rising due to the fact that a proportion of a heavy-weight blend which melts more slowly exceeds an optimal value. Besides, a factor of filling the furnace working space with a blend decreases due to the presence of a heavy-weight and dense material in a metal blend, which prevents from bringing a transformer to full power in view of the danger for degradation of crown and wall lining resistance, Therewith, a melting down period and an overall time of smelting grow and an energy consumption increases. That is why a further rise of a charge stock proportion in the first batch is not to the purpose.

The ratio of the charge stock and scrap equal to 1:(0.1–20.0) is in compliance with the conditions for achieving the best technical and economic characteristics. If this ratio is in excess of 1:0.1, then the method efficiency comes down because of an excessively high proportion of the charge stock having a high density and forming a dense layer susceptible to welding of separate pieces into a monolith. The latter melts considerably slower than separate pieces forming that layer.

If that ratio is less than 1:20, the positive effect of the charge stock comes down due to a relatively small weight in a metal blend. The charge stock leading a scrap metal with respect to the melting rate forms a liquid melt draining over cold pieces of scrap, and the formation of the aforementioned monoliths makes their melting difficult. At the same time, a melt formed is insufficient to form a liquid melt layer on a furnace hearth. This fact prevents from utilizing full capacities and from an early introduction of oxygen. This, in turn, leads to a protracted period of charge melting and increased energy consumption.

Charging the remaining scrap metal with the charge stock being disposed above said scrap enables to increase compactness of the blend, to afford stability of arcing, to bringe the process to full capacity as well as to provide the effect of bath boiling during the second melting period and oxidation period. Because of that, slag is maintained in a frothed state which improves thermal efficiency and protects the lining from arc radiation as well as provides for the possibility to come up to full commercial operation. Moreover, a continuous metal rimming during the periods of melting and oxidation affords removal of gases and occlusions and favours production of high-quality steel.

BRIEF DESCRIPTION OF THE DRAWING

The present invention is explained in more detail hereinbelow with reference to the drawing which is a fragmented schematic illustration of one embodiment of a casting machine for metallurgical conversion in accordance with the present invention.

BEST MODES FOR CARRYING OUT THE INVENTION

Figure 1:
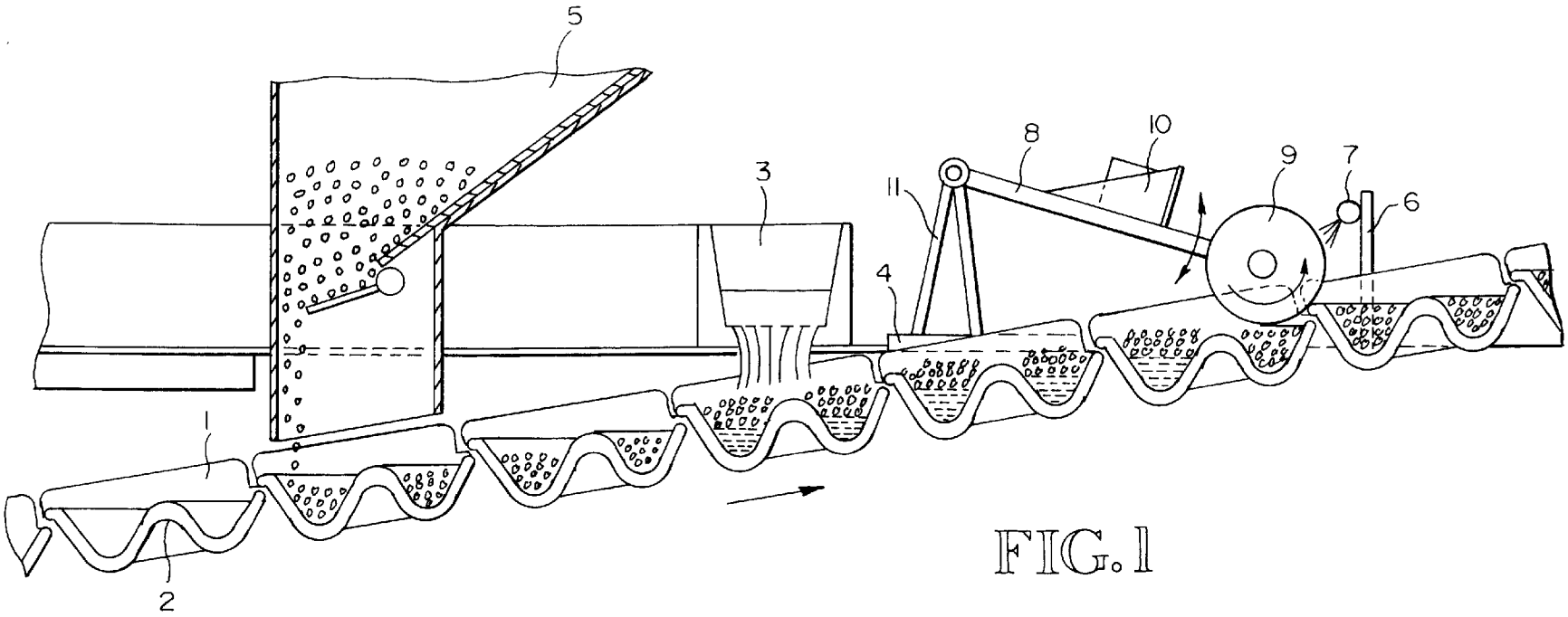

A casting machine comprises chain conveyers 1 with molding boxes 2 fixed thereon, a pouring device 3, a frame 4, a bin 5 with a feeder to supply solid fillers, a pipe-line 6 for supplying a cooling medium being connected to atomizers 7, a cantilever 8 with a hollow roller 9 and a weighting material 10 mounted on the cantilever with the possibility to move along its longitudinal axis. The cantilever with its one end is hinged in supports on the frame and with another end, by means of a pivotably installed roller, rests on a molding box.

The casting machine operates as follows. A laddle with a liquid pig iron is fed to the casting machine while pellets are fed to the bin with the feeder. The feeder gates open up and the pellets get into ingot molds. A travel speed bears a directly proportional relationship to the pellet flow rate. Ingot molds filled with the pellets are conveyed and poured with pig iron. In 1–60 seconds after pig iron has been cast, a material in the molding box is subjected to an additional action of a force the magnitude of which is equal to 100–10,000 N/sq. m.

A time interval from the moment of finishing the pig iron casting to the moment of applying said force is mentioned above as is an intensity of the force applied depending on the conditions of pouring.

EXAMPLE 1

Tests of the present method for the preparation a semifinished item were carried out on a pilot-plant casting machine in the variant of applying a mechanical force and a casting machine therefore using different intensities of said force on the surface of a material in a molding box and time periods for applying said force and in different ratios of a roller length to a working length of the molding box and an outside diameter of the roller to the molding box width. The results of these tests are presented in Table 1.

TABLE 1

| Test Nos. | Iron temperature, °C. | Force apply delay, sec. | Force intensity, N/sq.m | Roller diameter-Mold box width ratio | Roler length - Mold box length ratio | Pig weight, Kg | Filler distribution uniformity in the pig, Numbers |
|---|---|---|---|---|---|---|---|
| Prior-art | 1380 | — | — | — | — | 27.5 | 1 |
| 1 | 1260 | 1 | 1000 | 1.4 | 0.80 | 26.0 | 4 |
| 2 | 1380 | 20 | 100 | 1.35 | 0.85 | 25.5 | 3 |
| 3 | 1300 | 50 | 10000 | 1.25 | 0.90 | 27.0 | 5 |
| 4 | 1400 | 60 | 7500 | 1.1 | 0.95 | 26.0 | 4 |
| 5 | 1280 | 70 | 9000 | 1.9 | 0.7 | 25.0 | 2 |
| 6 | 1360 | 30 | 10000 | 1.5 | 1.0 | 27.5 | 1 |

The analysis of tests performed has showed that the claimed method and casting machine therefore enable to prepare foundry pigs of a semifinished item for metallurgical conversion having a uniform, heterogeneous composition with a uniform distribution of pellets in the bulk of a pig (4 numbers according to a five-member evaluation system).

EXAMPLE 2

A method in accordance with the present invention was carried out on a casting machine, 35 m in length and 5.8 m in width, having two conveyers each comprising 292 molding boxes. The casting machine was equipped with a device for a measured loading of a lumpy iron-ore material into the molding boxes of both conveyers. Molds were prepared in the molding boxes having 12.5 m in height and 318 sq. cm in cross-section wherein their travel speed was equal to 10 cm/sec. As an iron-ore material, roasted oxidized iron-ore pellets and a sinter-cake with the size of pieces equal to from 0.3 to 3.8 cm, that is to say in the range of from 0.025 to 0.300 of the molding box height, were used.

A pig iron casting rate referred to a molding box cross-section and to a conveyer travel speed was controlled in the range of (3–6):10. It was noted that with the ratio of linear velocities of a pig iron casting and a molding box movement exceeding 6:10, pig iron had not enough time to fill all spaces between solid particles of an iron-ore material, and molds prepared were porous with a nonuniform distribution of pig iron in the bulk of the mold. A part of solid particles was not seized by pig iron and was poured out of the molding boxes, which resulted in the preparation of poor-quality molds.

If the ratio of linear velocities was less than 3:10, then a blend material mold was overflowed with pig iron, the latter poured over into neighboring molding boxes, which resulted in violation of the conditions for constancy of the molding composition and in an increase of the mold weight.

In the test performed, more than 1,500 tons of a molded blend material for steel-making furnaces were produced. Molds were of 31–33 Kg each and contained 20–25 percent by weight of an iron-ore material, the rest being pig iron.

A molded blend material produced was remelted into steel in 3-, 6-, and 100-ton electric furnaces and in a 65-ton open-hearth furnace. In all cases, a positive effect was produced: a melting time was reduced by 30–50 percent, a fuel consumption—by 14–25 percent, a refractory material consumption—by 1–2 Kg per ton of steel, steel net costs were cut in comparison with steel produced from a conventional blend: scrap and metallized pellets.

EXAMPLE 3

In metallurgical reservoirs for charging a converter, a scrap metal and a semifinished item comprising 20 percent of pellets and 80 percent of iron-carbon alloy (pig iron) were prepared.

A solid blend for a 160-ton converter contained 25 tons of scrap and 12 tons of the semifinished item; a liquid pig iron was poured in the converter in the amount of 135 tons. A flow rate of slag-forming constituents was identical to that when using only scrap as a solid blend: lime, 12 tons; cand, 0.2 ton; ore pellets, 0.8 ton. Blowing a heat was carried out according to a conventional practice in line with operating instructions. Smelting proceeded smoothly, without any deviation from slag and thermal conditions and a required chemical composition. Steel produced was of Ст20 carbon steel grade. Following termination of the blow, deoxidizing agents were introduced into a liquid bath, the metal was tapped into a laddle which was transferred to a continuous casting machine.

The yield of a liquid metal was at a level of conventional smeltings when performed using only scrap in a metal blend, and equaled to 87.4 percent.

Pilot-plant smeltings using a semifinished item instead of a scrap metal as a quenching medium showed the effectiveness of said change, at the same time providing required slag and thermal conditions of smelting, the reduction of the copper content by 25 percent, the nickel content by 29 percent in comparison with smeltings when performed using only scrap as a solid blend.

EXAMPLE 4

Table 2 illustrates the effect of applying an action in the form of a mechanical load exceeding a buoyant force by 10 percent, on the stability of a composition of a semifinished item (a foundry pig) for metallurgical conversion and accordingly on smelting performance.

TABLE 2

| | Pellet content, % wt. in semifinished item | | | Oxygen deficit as a result of pellet mound, Kg per 100 Kg semi-finished item | Oxidation period |
|---|---|---|---|---|---|
| Nos. | Planed | Actual | mound | without loading | rise, Minutes |
| 1. | 25 | 17 | 8 | 2.10 | 8 |
| 2. | 25 | 15 | 10 | 2.60 | 10 |
| 3. | 25 | 18 | 7 | 1.80 on load | 7 |
| 4. | 25 | 25.0 | — | — | absent |
| 5. | 25 | 24.7 | 0.3 | 0.06 | absent |
| 6. | 25 | 25.0 | — | — | absent |
| 7. | 25 | 25.0 | — | — | absent |
| 8. | 25 | 24.8 | 0.2 | 0.04 | absent |

EXAMPLE 5

Pilot-plant smeltings were performed in 100-ton arc furnaces. Electric anisotropic steel was produced. Scrap (crop ends, defective slabs, amortization scrap) and a charge stock in various ratios therebetween were used in a metal blend composition.

A blend comprising a charge stock and scrap was loaded in layers into a bucket and charged into a furnace. The charge was also furnished with lime, 1.5–4 tons; a sinter cake, 2–4 tons; and, during separate smeltings, with cand in the amount of 300–50 tons per each smelting. After melting a charge stock, a bucket was added with a charge stock above scrap. Steel making was performed using a crown tuyere for oxygen lancing. In the process of melting, a sinter cake and cand were added, if required. To produce a charge stock, conversion pig iron and iron-ore pellets were used in a (81–84):(19–16) ratio therebetween. On melting of the blend in sample 1, the metal with the following chemical composition (on a weight percentage basis) was produced: C=0.18–1.00; Mn=0.10–0.20; P=0.009–0.016; S=0.005–0.027; Cr=0.03–0.09; Ni=0.05–0.09; Cu=0.05–0.13.

After refining and preliminary deoxidizing, the metal was tapped into a laddle.

Technical-and-economic performance of electro-smelting of electric steel produced in accordance with the present method are presented in Table 3 in comparison with smeltings of the current manufacture (on the average with respect to 20 smeltings).

TABLE 3

| Nos | Number of batches. | Charge stock content(% by weight of furnace burden | Charge stockmetal scrap ratio (in parts) | Power con sump-tion per each smelting (kilowatt-hour) | Smelt duration (hour,min) |
|---|---|---|---|---|---|
| Com parat ive | 1 | 50 | 1:1.0 | 51838 | 3-08 |
| 1 | 2 | 2 | 1:30 | 51120 | 3-02 |
| 2 | 2 | 3 | 1:20 | 49800 | 2-55 |
| 3 | 2 | 10 | 1:5.4 | 48240 | 2-53 |
| 4 | 2 | 20 | 1:0.8 | 47100 | 2-49 |
| 5 | 2 | 30 | 1:0.2 | 46800 | 2-45 |
| 6 | 2 | 32 | 1:0.1 | 47460 | 2-51 |
| 7 | 2 | 34 | 1:0.007 | 49830 | 2-57 |

As one can see from the Table, the proposed method for steel-making in an arc furnace provides for improvement of technical-and-economic performance of smelting at the expense of reducing a duration of the melting period by 7–12 percent and a specific power consumption by 4–10 percent.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for the preparation of a semifinished item for metallurgical conversion, the semifinished item comprising a liquid iron-carbon alloy and a solid filler of lesser density than the iron-carbon alloy, the process comprising forming of said item in a molding box of a casting machine from a solid filler and a liquid iron-carbon alloy followed by cooling, characterized in that in the process of forming the semifinished item said solid filler and iron-carbon alloy are subjected to the action of a distributed mechanical force of a magnitude which in a direction perpendicular to an upper surface of the the liquid iron-carbon alloy is at least equal to a maximum buoyant force acting upon said solid filler in said liquid iron-carbon alloy, whereby floating of the solid filler in said liquid iron-carbon alloy is prevented.

2. A process according to claim 1, characterized in that forming of said semifinished item is carried out by casting a molding box with a liquid iron-carbon alloy, charging a surface of the liquid iron-carbon alloy with a solid filler and immersing said solid filler into a liquid phase under the action of a mechanical force the magnitude of which exceeds a minimum buoyant force acting upon said solid filler in said iron-carbon alloy by not less than 5 percent.

3. A process according to claim 1, characterized in that said mechanical force has a magnitude of 100–10,000 N/sq.m.

4. A process according to claim 3, characterized in that said force is applied in 1–60 seconds after said solid filler has been cast with a liquid iron-carbon alloy.

5. A casting machine for the preparation of a semifinished item for metallurgical conversion comprising a conveyor with molding boxes, a pouring device adapted to pour a liquid iron-carbon alloy into the molding boxes, and a bin with a feeder to charge a solid filler into the molding boxes, the machine additionally comprising a device adapted to apply a mechanical action to said solid filler and liquid iron-carbon alloy, which action prevents floating of the solid filler in the liquid iron-carbon alloy.

6. A casting machine according to claim 5, further comprising atomizers connected to a pipe-line for supplying a cooling medium, wherein said device for applying said mechanical action to said solid filler and liquid iron-carbon alloy comprises a cantilever having a longitudinal axis and a pivotably installed hollow roller, and a weighting material mounted on the cantilever with a capability of moving along the longitudinal axis, a first end of the cantilever hinged on a frame, the frame disposed such that said roller rests on at least one of said molding boxes, the length of said hollow roller is from 0.80 to 0.95 of a working length of the molding box, an outside diameter of said roller is from 1.1 to 1.4 of the molding box width, the atomizers are located in the vicinity of said roller and oriented to a lateral face of the roller.

7. A method for the production of a composite feedstock for steelmaking, comprising the steps of:

placing solid oxidants in a molding box of a casting machine, the molding box being disposed on a conveyor;

pouring molten iron onto the solid oxidants to form a blend while the molding box is moving on the conveyor, the ratio between an average linear pouring speed of the molten iron and a linear movement speed of the molding box being in the range of 3:10 and 6:10; and subjecting the blend to a distributed mechanical force perpendicular to an upper surface of the blend to prevent the oxidants from floating in the iron.

8. The method of claim 7, further comprising the step of cooling the blend.

9. The method of claim 7, wherein the solid oxidants comprise pieces having a maximum size of approximately 0.025 to approximately 0.300 of a height of the molding box.

10. The method of claim 7, wherein the molten iron comprises an iron-carbon alloy and the solid oxidants comprise a total amount of oxygen required for oxidation of 5 to 95 percent of the carbon present in the alloy and for complete rated oxidation of any remaining ingredients of the alloy having an affinity to oxygen greater than carbon has.

11. The method of claim 7, wherein the mechanical force has a magnitude of between approximately 100 $N/m^2$ and approximately 10,000 $N/m^2$ and is applied within approximately 60 seconds of the pouring of the iron into the molding box.

12. A pig caster for the manufacture of a composite feedstock for steelmaking, the pig caster comprising:

a least one molding box disposed upon a conveyor;

a device for pouring molten metal into the molding box;

a device for placing solid oxidant onto the molding box;

at least one atomizer for spraying a cooling agent into the molding box and any contents of the molding box; and a device adapted to apply a mechanical force to the oxidizer within the molding box to prevent the oxidizer from floating in the metal.

13. A pig caster according to claim 12, wherein the device for applying the mechanical force to the oxidizer comprises a pivotally mounted cantilever having a longitudinal axis and a hollow roller, and a weight mounted on the cantilever with a capability of moving along the longitudinal axis, the cantilever further comprising a pivotably installed roller resting on the molding box.

14. A pig caster according to claim 13, the roller having a length between approximately 0.80 and 0.90 times a working length of the molding box and an outside diameter between approximately 1.1 and 1.4 times a width of the molding box; an atomizer being located proximate the roller and oriented to spray a lateral face of the roller.

15. A method for the production of steel by charging a furnace having a capacity with layers of scrap; a composite charge stock manufactured by pouring molten iron onto solid oxidants to form a blend, during the formation of which the solid oxidants are prevented by the application of a mechanical force from floating in the iron; and fluxing components, the charging followed by heating, melting, and oxygen blowing, wherein the furnace is charged in two batches: the first batch comprising combination of the charge stock and the scrap in an amount between 2% and 32% of the furnace capacity, the charge stock being layered with the scrap in a ratio between approximately 1:0:1 and approximately 1:20, and at least partial melting of the combination; the second batch comprising addition to the combination of the first batch of a combination comprising a further layer of scrap beneath a further layer of charge stock.

* * * * *

UNITED STATES PATENT AND TRADEMARK OFFICE

CERTIFICATE OF CORRECTION

PATENT NO. : 5,817,164

DATED : October 6, 1998

INVENTOR(S) : Dorofeev et al.

It is certified that error appears in the above-indentified patent and that said Letters Patent is hereby corrected as shown below:

Column 14, line 51, delete the first occurrence of the word "a", and insert therefor --at--.

Column 14, line 54, delete "into", and insert therefor --onto--.

Signed and Sealed this

Second Day of February, 1999

*Attest:*

*Attesting Officer*

*Acting Commissioner of Patents and Trademarks*